US010794209B2

(12) United States Patent
Matsumoto et al.

(10) Patent No.: US 10,794,209 B2
(45) Date of Patent: Oct. 6, 2020

(54) TURBINE ROTOR BLADE AND ROTARY MACHINE

(71) Applicant: MITSUBISHI HEAVY INDUSTRIES, LTD., Tokyo (JP)

(72) Inventors: Kazuyuki Matsumoto, Tokyo (JP); Hideaki Sugishita, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 56 days.

(21) Appl. No.: 16/281,407

(22) Filed: Feb. 21, 2019

(65) Prior Publication Data

US 2019/0301297 A1 Oct. 3, 2019

(30) Foreign Application Priority Data

Mar. 29, 2018 (JP) ..... 2018-063450

(51) Int. Cl.

| | |
|---|---|
| ***F01D 11/08*** | (2006.01) |
| ***F01D 5/16*** | (2006.01) |
| ***F01D 5/20*** | (2006.01) |
| ***F01D 5/26*** | (2006.01) |

(52) U.S. Cl.

CPC ..... *F01D 11/08* (2013.01); *F01D 5/16* (2013.01); *F01D 5/20* (2013.01); *F01D 5/26* (2013.01); *F05D 2220/31* (2013.01); *F05D 2240/55* (2013.01); *F05D 2260/96* (2013.01)

(58) Field of Classification Search

CPC ..... F01D 5/16; F01D 5/20; F01D 5/22; F01D 5/26; F01D 11/02; F01D 11/08; F05D 2220/31; F05D 2240/55; F05D 2260/96

See application file for complete search history.

(56) References Cited

U.S. PATENT DOCUMENTS

| | | | | |
|---|---|---|---|---|
| 4,534,701 | A * | 8/1985 | Wisser | F01D 11/08 415/168.4 |
| 6,632,069 | B1 * | 10/2003 | Naljotov | F01D 5/225 415/173.5 |
| 2017/0130588 | A1 * | 5/2017 | Townes | F01D 5/225 |

FOREIGN PATENT DOCUMENTS

| | | |
|---|---|---|
| CA | 1 145 263 | 4/1983 |
| JP | 56-47603 | 4/1981 |
| JP | 62-154201 | 9/1987 |
| JP | 2006-104952 | 4/2006 |
| JP | 2007-120476 | 5/2007 |
| JP | 2010-159667 | 7/2010 |
| JP | 2013-76341 | 4/2013 |

(Continued)

*Primary Examiner* — Brian P Wolcott

(74) *Attorney, Agent, or Firm* — Wenderoth, Lind & Ponack, L.L.P.

(57) ABSTRACT

A tip shroud of a turbine rotor blade includes at least one first through hole. The first through hole includes a first opening and a second opening, the first opening penetrating the tip shroud in a radial direction so as to bring a first cavity and an inter-blade flow passage into communication. The first cavity is defined between a first seal fin and a second seal fin. The first seal fin extending in the radial direction on an outer side in a radial direction of the tip shroud, and the second seal fin extending in the radial direction at a position spaced part from the first seal fin in a direction of an axis of a rotor body. The first opening is formed at an intermediate position between the first seal fin and the second seal fin. The second opening is formed at a position facing the inter-blade flow passage.

6 Claims, 8 Drawing Sheets

(56) References Cited

FOREIGN PATENT DOCUMENTS

| | | |
|---|---|---|
| JP | 2014-141912 | 8/2014 |
| JP | 2017-155625 | 9/2017 |

* cited by examiner

A – A

TURBINE ROTOR BLADE AND ROTARY MACHINE

TECHNICAL FIELD

The present disclosure relates to a turbine rotor blade and a rotary machine.

BACKGROUND ART

In a rotary machine such as a steam turbine or a gas turbine, there is a case in which self-excited vibration such as low-frequency vibration occurs, and some measures are proposed (for example, see Patent Document 1).

For example, a steam turbine disclosed in Patent Document 1 is provided with a small hole in a rotor blade shroud of a steam turbine stage. The hole brings inter-rotor-blade passage of rotor blades and rotor blade tip gap on an inlet side of a rotor blade tip seal fin into communication, and has an angle such that steam flows out to the rotor blade tip gap in an opposite direction to a rotational direction of the rotor blades.

CITATION LIST

Patent Literature

Patent Document 1: JPS62-154201 (Utility Model)

SUMMARY

In recent years, a rotary machine such as a steam turbine or a gas turbine has a tendency to decrease a rotor diameter and provide a multistage blade in order to improve turbine efficiency. Therefore, the rotor diameter is decreased, and a rotor shaft is elongated, and thus self-excited vibration such as low-frequency vibration tends to occur easily. Hence, it is required to provide a measure for suppressing self-excited vibration more effectively.

In view of the above, an object of at least one embodiment of the present invention is to suppress occurrence of self-excited vibration in the rotary machine.

(1) A turbine rotor blade according to at least one embodiment of the present invention includes a plurality of blade bodies which are mounted so as to extend in a radial direction from a rotor body rotating about an axis in a casing, the plurality of blade bodies being disposed at intervals in a circumferential direction of the rotor body, and an annular tip shroud connected to each end part of the plurality of blade bodies.

The tip shroud includes at least one first through hole, and the first through hole penetrates the tip shroud in the radial direction so as to bring a first cavity and an inter-blade flow passage into communication.

The first cavity is defined between a first seal fin and a second seal fin. The first seal fin extends in the radial direction from one of an outer peripheral surface of the tip shroud or an inner peripheral surface of the casing toward the other of the outer peripheral surface or the inner peripheral surface, and has a tip part. The first seal fin forms a gap between the tip part and the other of the outer peripheral surface or the inner peripheral surface. The second seal fin extends in the radial direction from one of the outer peripheral surface of the tip shroud or the inner peripheral surface of the casing toward the other of the outer peripheral surface or the inner peripheral surface at a position spaced apart from the first seal fin in a direction of the axis, and has a tip part. The second seal fin forms a gap between the tip part and the other of the outer peripheral surface or the inner peripheral surface. The inter-blade flow passage is formed between a pair of adjacent blade bodies in the circumferential direction of the rotor body.

The first through hole includes a first opening opened on a side of the first cavity and a second opening opened on a side of the inter-blade flow passage.

The first opening is formed at an intermediate position between the first seal fin and the second seal fin.

The second opening is formed at a position facing the inter-blade flow passage and having the same static pressure as a static pressure at a position facing the first opening.

It is known that in general, self-excited vibration in the rotary machine is caused by formation of a circumferentially uneven pressure distribution in cavities between seal fins when a flow (swirl flow) passing through a stator vane and having a strong circumferential velocity component (a swirl component, or a swirling component) passes through the seal fins.

If the circumferentially uneven pressure distribution is formed in the cavities, while a force pressing the rotor inward in the radial direction by a pressure in each of the cavities increases in a portion with a high pressure in each cavity between the seal fins, the force pressing the rotor inward in the radial direction by the pressure in each cavity decreases in a portion with a low pressure in each cavity between the seal fins.

With regard to a pressing force pressing the rotor inward in the radial direction by the pressure in each cavity, if a pressing force from one side and a pressing force from the other side facing with the one side across the axis of the rotor balance each other, the pressing force from one side and the pressing force from the other side facing with the one side across the axis of the rotor are offset each other.

However, for example, if the pressing force from one side becomes larger than the pressing force from the other side, the rotor is pressed from one side toward the other side by a force of a difference between both the pressing forces facing across the axis of the rotor. Therefore, if the difference between the pressing force from one side and the pressing force from the other side facing across the axis of the rotor grows, self-excited vibration of the rotor is induced.

In this regard, with the above configuration (1), since the first through hole is formed which penetrates the tip shroud in the radial direction so as to bring the first cavity and the inter-blade flow passage into communication, it is possible to bring a static pressure in the first cavity closer to the static pressure of the inter-blade flow passage and to suppress formation of the circumferentially uneven pressure distribution in the first cavity. Thus, it is possible to suppress occurrence of self-excited vibration in the rotary machine using the turbine rotor blade of the above configuration (1).

The rotor body expands and contracts in the direction of the axis by thermal expansion, changing its relative position with the casing in the direction of the axis. Thus, if the seal fins are formed in the casing, a relative position of the tip parts of the seal fins and the tip shroud in the direction of the axis changes. If the relative position of the tip parts of the seal fins and the tip shroud in the direction of the axis extremely changes, the first opening deviates from the first cavity.

In this regard, with the above configuration (1), since the first opening is formed at the intermediate position between the first seal fin and the second seal fin, as compared with a case in which the first opening is formed at a position approaching one of the seal fins from the intermediate position between the first seal fin and the second seal fin, it is possible to reduce a possibility of the first opening deviating from the first cavity by changing the relative position of the tip parts of the seal fins and the tip shroud in the direction of the axis.

In addition, with the above configuration (1), since the second opening is formed at the position facing the inter-blade flow passage and having the same static pressure as the static pressure of the position facing the first opening, a working fluid does not flow between the first cavity and the inter-blade flow passage if the above-described circumferentially uneven pressure distribution which may cause self-excited vibration in the rotary machine is not formed in the cavities. Thus, it is possible to suppress a decrease in turbine efficiency by, for example, a flow of the working fluid flowing through the inter-blade flow passage to the first cavity.

(2) In some embodiments, in the above configuration (1), the first through hole includes the first opening opened on the side of the first cavity and a first-cavity-side flow passage portion connected to the first opening, and the first-cavity-side flow passage portion is oriented to an upstream side of a rotational direction of the rotor body in the first cavity.

It is known that in general, self-excited vibration in the rotary machine is generated easily as a circumferential velocity of the working fluid flowing in the cavities between the seal fins in the circumferential direction increases.

In this regard, with the above configuration (2), since the first-cavity-side flow passage portion is oriented to the upstream side of the rotational direction of the rotor body in the first cavity, when flowing out to the first cavity, the working fluid flowing through the inter-blade flow passage flows out from the first opening toward the upstream side of the rotational direction of the rotor body in the first cavity, that is, flows out so as to go against a flow of the working fluid flowing in the first cavity toward the circumferential direction. Thus, suppression of a flow velocity of the working fluid flowing in the first cavity toward the circumferential direction contributes to suppression of occurrence of self-excited vibration.

(3) In some embodiments, in the above configuration (1) or (2), the first through hole includes the second opening opened on the side of the inter-blade flow passage and an inter-blade side flow passage portion connected to the second opening, and the inter-blade-side flow passage portion is oriented to a downstream side of the inter-blade flow passage.

With the above configuration (3), since the inter-blade-side flow passage portion is oriented to the downstream side of the inter-blade flow passage, when flowing out to the inter-blade flow passage, the working fluid flowing through the first cavity flows out along the flow of the working fluid in the inter-blade flow passage. Thus, it is possible to suppress a loss associated with merging of the flow of the working fluid in the inter-blade flow passage and the working fluid flowing from the first through hole to the inter-blade flow passage, and to suppress the decrease in turbine efficiency.

(4) In some embodiments, in any one of the above configurations (1) to (3), the at least one first through hole includes a plurality of first through holes having the same diameter, and the plurality of first through holes are formed at regular intervals along a circumferential direction over an entire periphery of the annular tip shroud.

With the above configuration (4), since the plurality of first through holes having the same diameter are formed at the regular intervals along the circumferential direction over the entire periphery of the annular tip shroud, it is possible to suppress a loss in rotational balance of the rotor including the rotor body and the turbine rotor blade.

(5) In some embodiments, in any one of the above configurations (1) to (4), the tip shroud includes at least one second through hole, and the second through hole penetrates the tip shroud in the radial direction so as to bring a second cavity and the inter-blade flow passage into communication.

The second cavity is defined between the second seal fin and a third seal fin. The third seal fin extends in the radial direction from one of the outer peripheral surface of the tip shroud or the inner peripheral surface of the casing toward the other of the outer peripheral surface or the inner peripheral surface at a position spaced apart from the second seal fin in the direction of the axis from the first seal fin toward the second seal fin, and has a tip part. The third seal fin forms a gap between the tip part and the other of the outer peripheral surface or the inner peripheral surface.

With the above configuration (5), since the second through hole is formed which penetrates the tip shroud in the radial direction so as to bring the second cavity and the inter-blade flow passage into communication, it is possible to bring a static pressure in the second cavity closer to the static pressure of the inter-blade flow passage and to suppress formation of a circumferentially uneven pressure distribution in the second cavity.

(6) A rotary machine according to at least one embodiment of the present invention includes the turbine rotor blade according to any one of the above configurations (1) to (5), the casing, and the rotor body.

With the above configuration (6), since the rotary machine includes the turbine rotor blade according to any one of the above configurations (1) to (5), it is possible to suppress occurrence of self-excited vibration.

According to at least one embodiment of the present invention, it is possible to suppress occurrence of self-excited vibration in the rotary machine.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
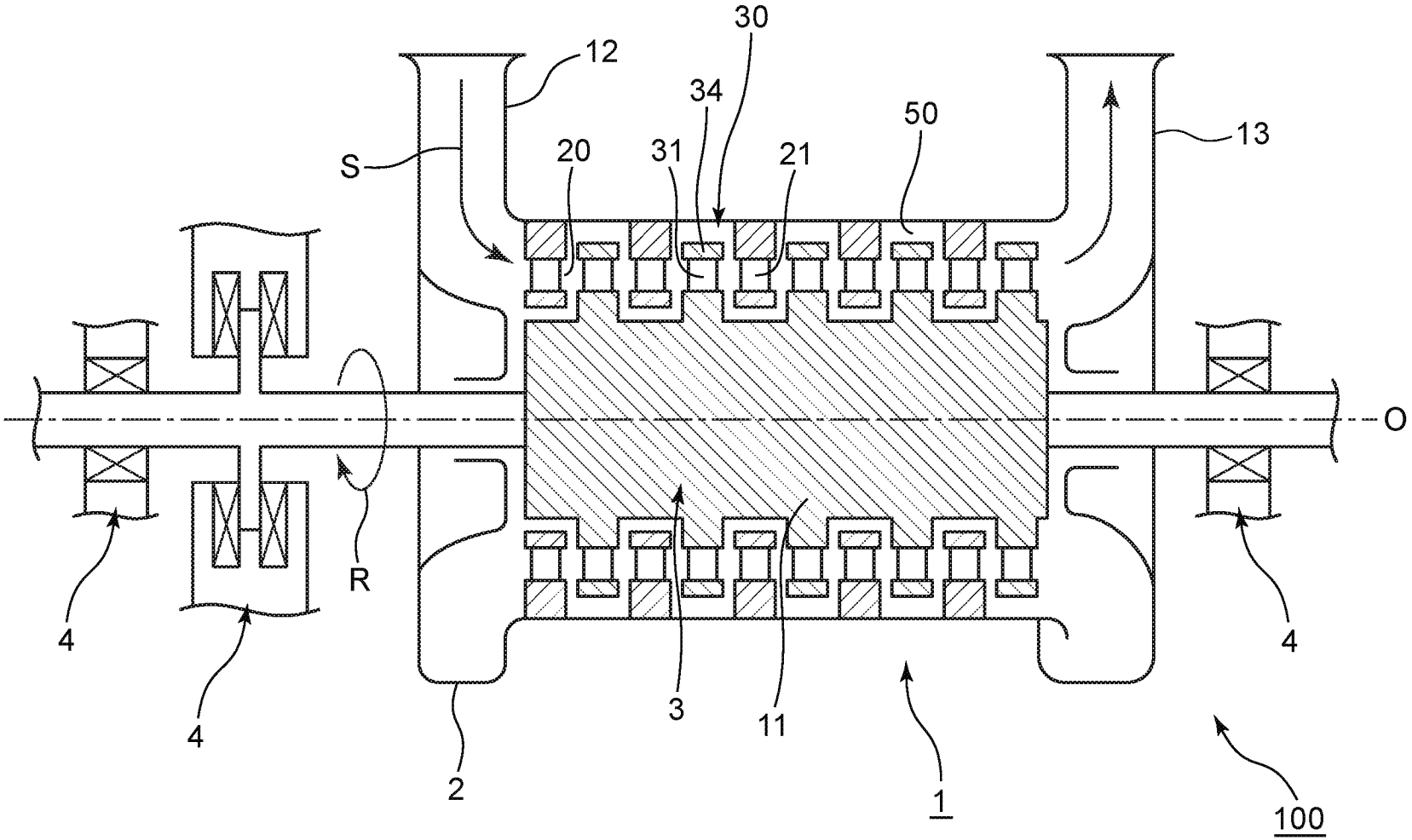
FIG. 1 is a view for describing a steam turbine as an example of a rotary machine including a turbine rotor blade according to some embodiments.

FIG. 1 is a view for describing a steam turbine as an example of a rotary machine including a turbine rotor blade according to some embodiments. FIGS. 2 to 5 are schematic views taken in the vicinity of a tip end part of a blade element of the turbine rotor blade according to some embodiments.

As shown in FIG. 1, a steam turbine plant 100 includes a rotor body 11 rotating about an axis O, a rotor 3 connected to the rotor body 11, a steam supply pipe 12 supplying steam S as a working fluid from a steam supply source (not shown) to a steam turbine 1, and a steam discharge pipe 13 connected to a downstream side of the steam turbine 1 and discharging steam.

In FIG. 1, a side where the steam supply pipe 12 is positioned is referred to as an upstream side, and a side where the steam discharge pipe 13 is positioned is referred to as a downstream side. The following description will be made according to this.

As shown in FIG. 1, the steam turbine 1 includes the rotor 3 extending along a direction of the axis O, a casing 2 covering the rotor 3 from an outer peripheral side, and bearing portions 4 rotatably supporting the rotor body 11 about the axis O.

The rotor 3 includes the rotor body 11 and a turbine rotor blade 30. The turbine rotor blade 30 is rotor blade rows including a plurality of blade bodies 31 and a tip shroud 34. The plurality of rows are disposed at regular intervals in the direction of the axis O.

The plurality of blade bodies 31 are mounted so as to extend in a radial direction from the rotor body 11 rotating about the axis O in the casing 2 and are disposed at intervals in a circumferential direction of the rotor body 11. Each of the plurality of blade bodies 31 is a member having an airfoil cross-section, as seen in the radial direction.

The tip shroud 34 is an annular tip shroud connected to each tip end part (an end part on the outer side in the radial direction) of the plurality of blade bodies 31.

The casing 2 is a nearly cylindrical member disposed so as to cover the rotor 3 from the outer peripheral side. Furthermore, a plurality of stator vanes 21 are disposed along an inner peripheral surface 25 of the casing 2. The plurality of stator vanes 21 are arranged along a circumferential direction of the inner peripheral surface 25 and the direction of the axis O. Furthermore, the turbine rotor blade 30 is disposed so as to enter regions between the plurality of adjacent stator vanes 21.

Inside the casing 2, a region where the stator vanes 21 and the turbine rotor blade 30 are arranged forms a main flow passage 20 through which the steam S as the working fluid flows.

Furthermore, a space is formed between the tip shroud 34 and the inner peripheral surface 25 of the casing 2. The space will be referred to as a cavity 50.

Figure 2:
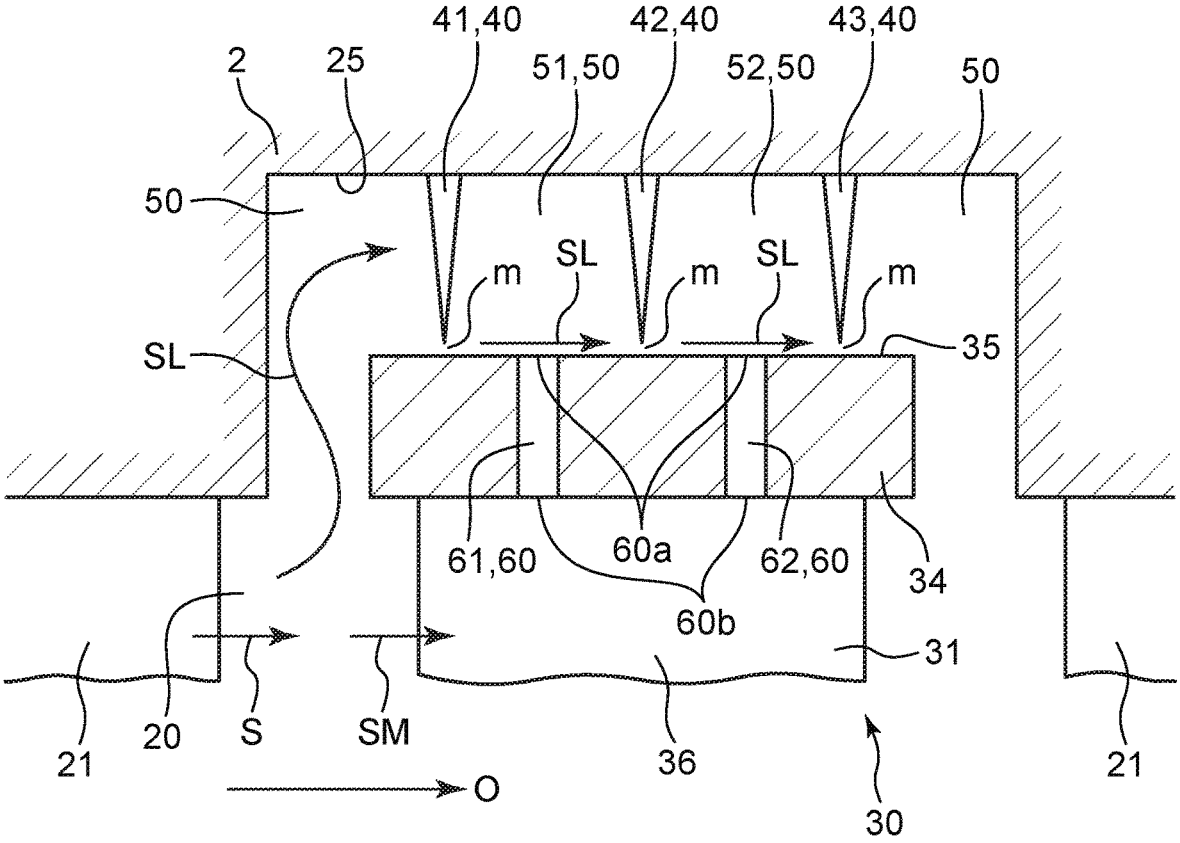
FIG. 2 is a schematic view taken in the vicinity of a tip end part of a blade element of the turbine rotor blade according to some embodiments.
Figure 3:
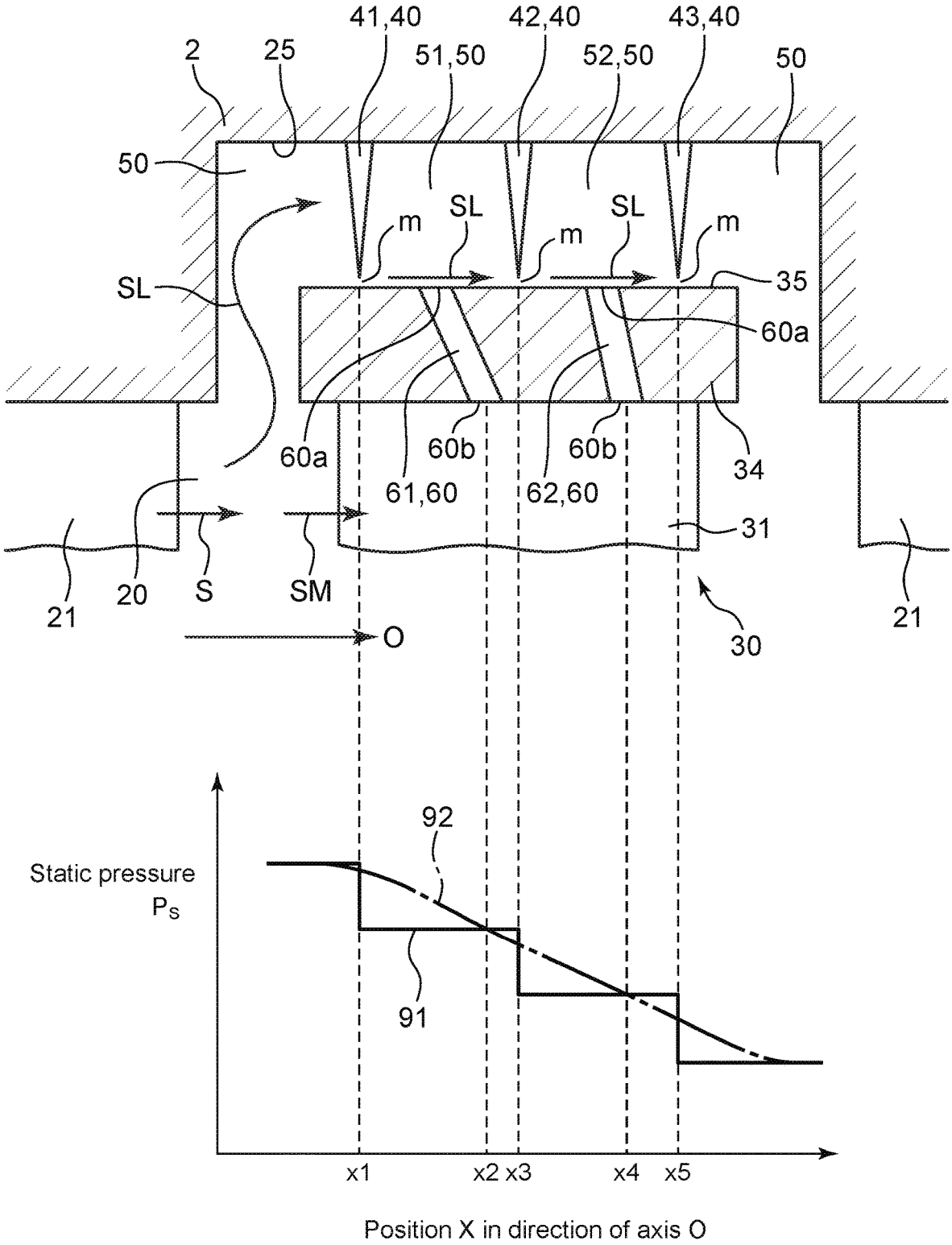
FIG. 3 is a schematic view taken in the vicinity of a tip end part of a blade element of the turbine rotor blade according to some embodiments.
Figure 4:
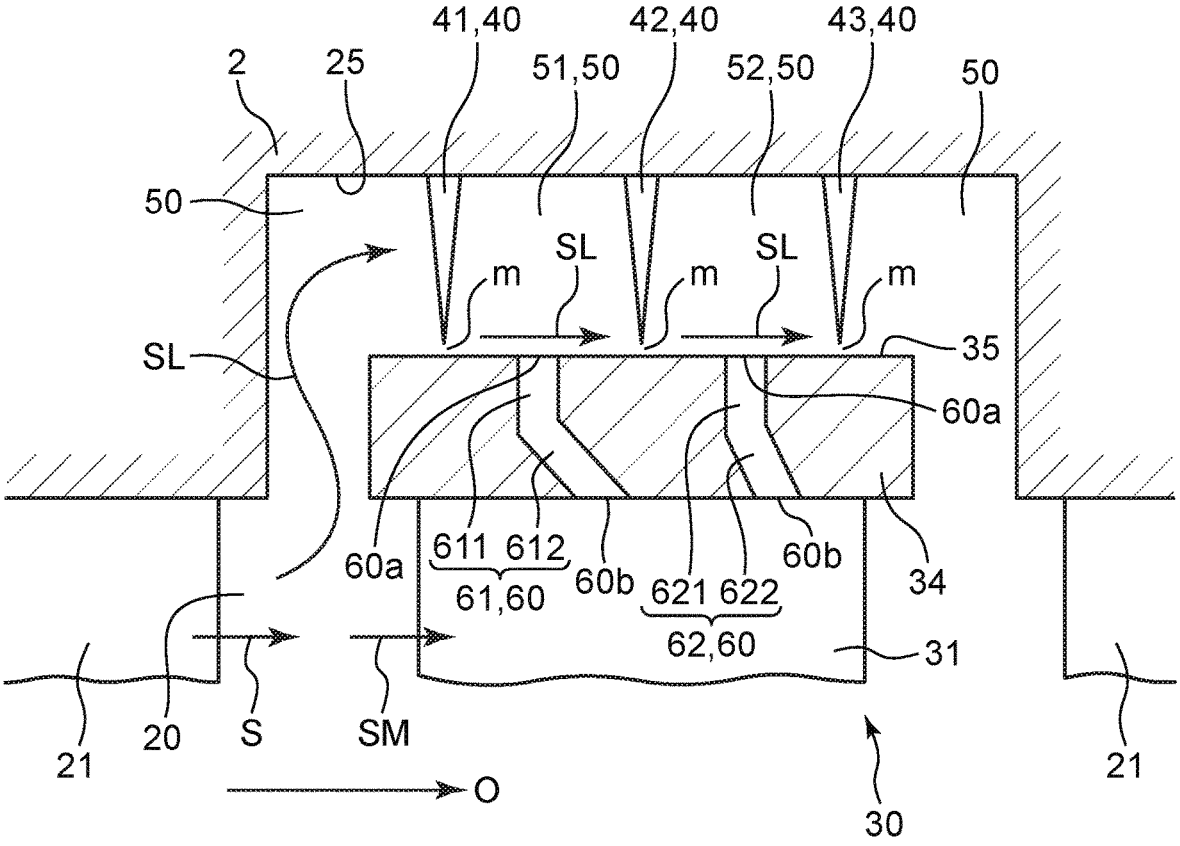
FIG. 4 is a schematic view taken in the vicinity of a tip end part of a blade element of the turbine rotor blade according to some embodiments.

As shown in FIGS. 2 to 5, the cavities 50 according to some embodiments include seal fins (seal structures) 40. The seal fins 40 of some embodiments shown in FIGS. 2 to 4 are annular members extending inward in the radial direction from the inner peripheral surface 25 of the casing 2. More specifically, the seal fins 40 each protrude from the inner peripheral surface 25 of the casing 2 so as to have a shape with a thickness in the direction of the axis O gradually decreasing from an outer side in the radial direction toward the inner side of the radial direction. In some embodiments shown in FIGS. 2 to 5, the three rows of seal fins 40 are arranged inside the cavities 50 along the direction of the axis O, and the seal fins are referred to as a first seal fin 41, a second seal fin 42, and a third seal fin 43 in this order from the upstream side. Like a seal fin 40A (second seal fin 42) of the embodiment shown in FIG. 5, the seal fins 40 may be configured to be formed on an outer surface 35 of the tip shroud 34 and extend outward in the radial direction from the outer surface 35 of the tip shroud 34 toward the inner peripheral surface 25 of the casing 2.

As shown in FIGS. 2 to 5, in some embodiments, the seal fins 40 form minute gaps m between tip parts on the inner side of the radial direction and the outer surface 35 of the tip shroud 34 facing the tip parts or the inner peripheral surface 25 of the casing 2. Considering thermal expansion amounts of the casing 2 and blade body 31, a centrifugal expansion amount of the blade body 31, and the like, a dimension of each of the gaps m in the radial direction of the rotor 3 is decided in a range in which the tip part of a corresponding one of the seal fins 40 does not contact a member of a counterpart facing the tip part.

Of the cavities 50 according to some embodiments shown in FIGS. 2 to 5, a region defined between the first seal fin 41 and the second seal fin 42 is referred to as a first cavity 51, and a region defined between the second seal fin 42 and the third seal fin 43 is referred to as a second cavity 52.

Figure 6:
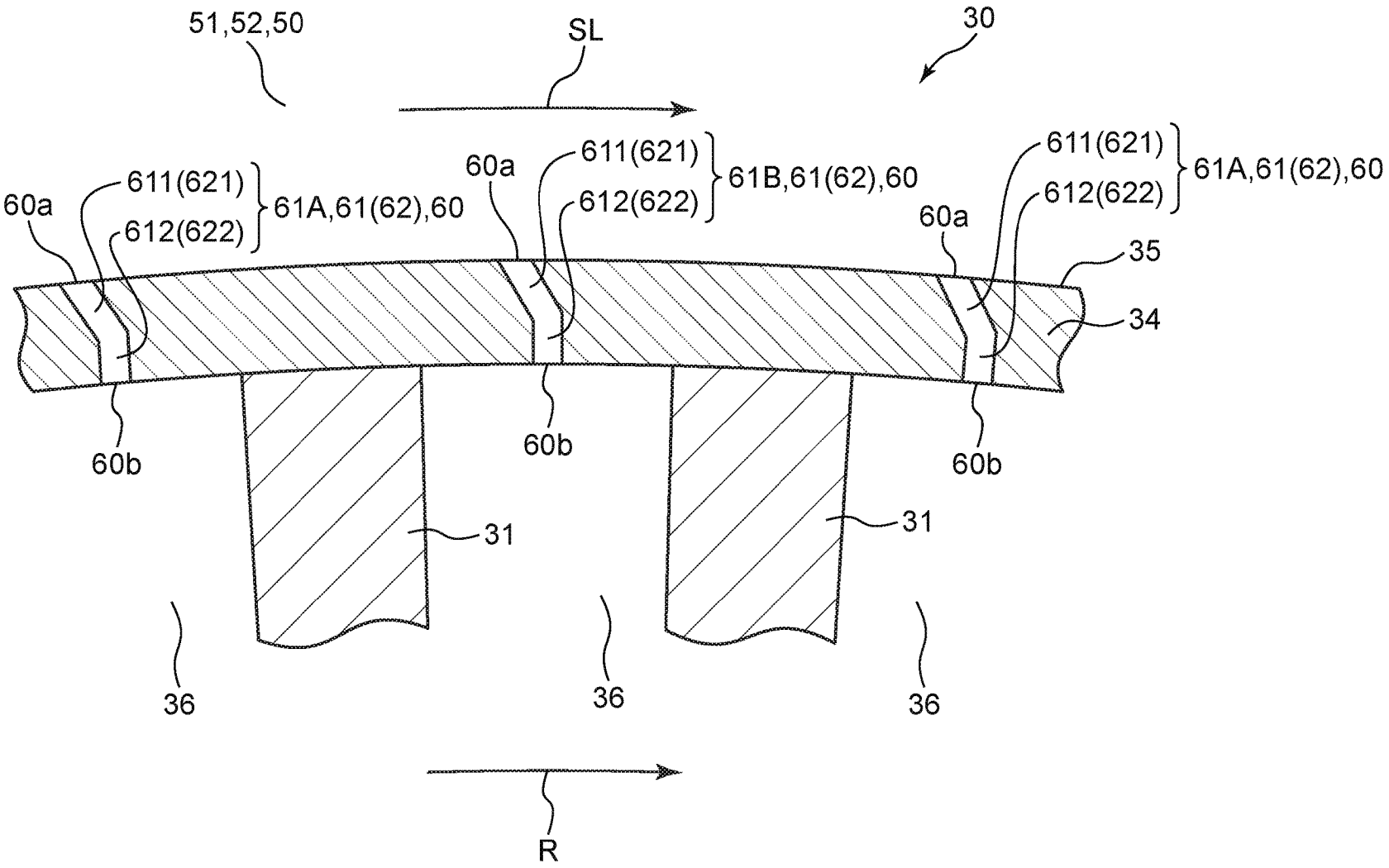
FIG. 6 is a schematic cross-sectional view of the turbine rotor blade according to an embodiment, taken along a circumferential direction.
Figure 7:
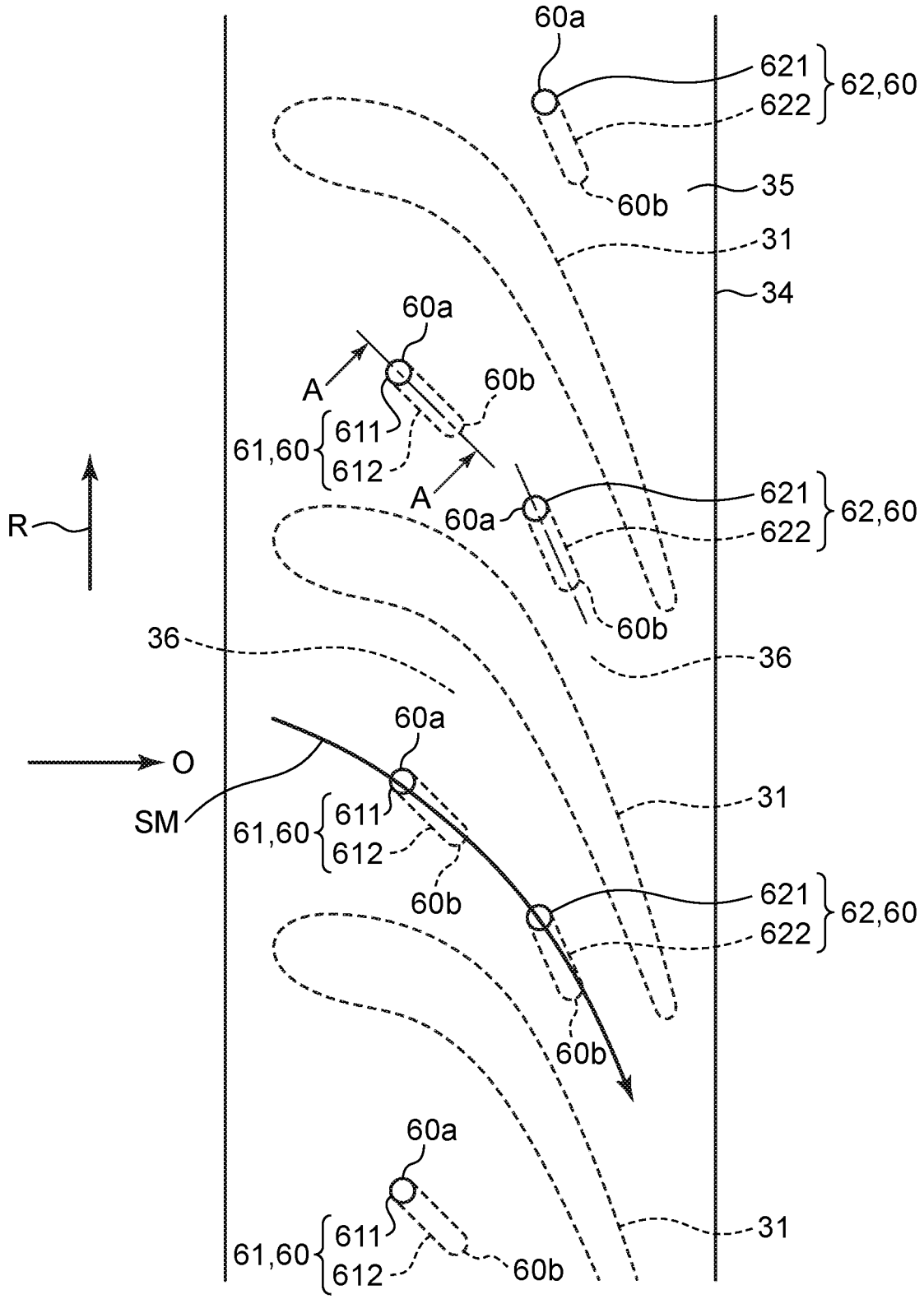
FIG. 7 is a schematic view of the turbine rotor blade according to another embodiment of, as seen on an outer side in a radial direction.
Figure 8:
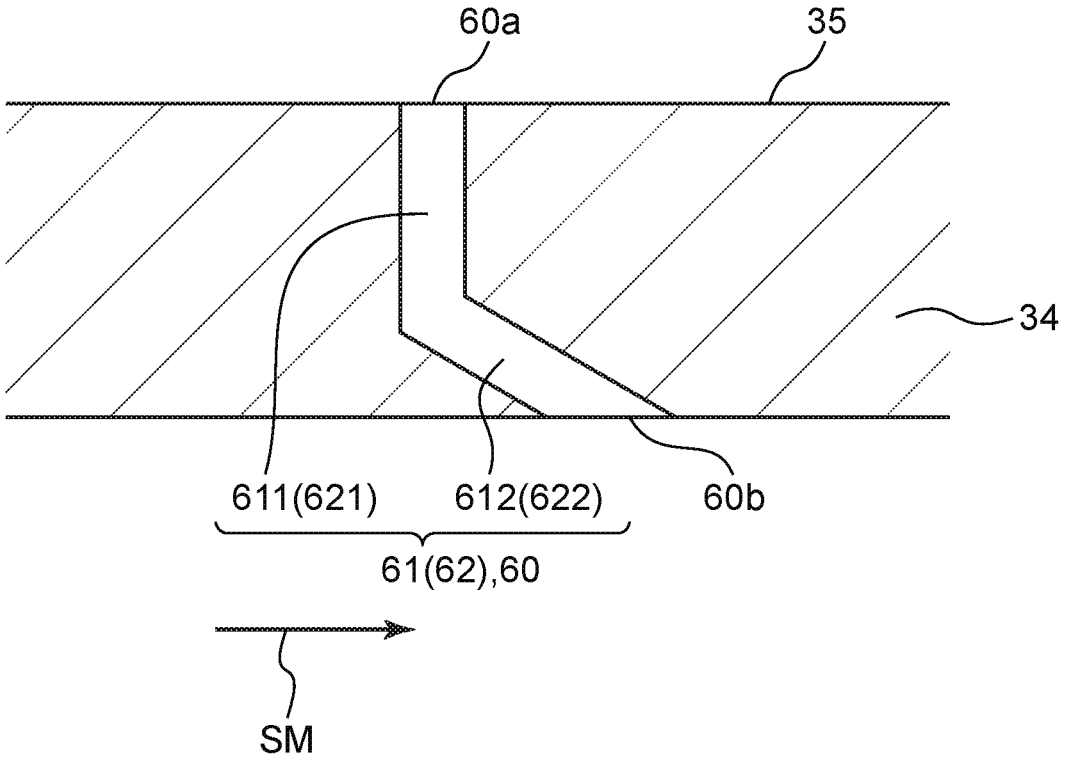
FIG. 8 is a cross-sectional view of a tip shroud taken along line A-A in FIG. 7.

Next, with reference to FIGS. 2 to 8, an effect of the steam turbine 1 according to some embodiments will be described. FIG. 6 is a schematic cross-sectional view of the turbine rotor blade 30 according to an embodiment, taken along the circumferential direction, that is, as seen in the direction of the axis O. FIG. 7 is a schematic view of the turbine rotor blade 30 according to another embodiment, as seen on the outer side in the radial direction. FIG. 8 is a cross-sectional view of the tip shroud 34 taken along line A-A in FIG. 7.

In the steam turbine plan 100 according to some embodiments, the steam S from the steam supply source is supplied to the steam turbine 1 via the steam supply pipe 12.

The steam S supplied to the steam turbine 1 reaches the main flow passage 20. The steam S reaching the main flow passage 20 flows toward the downstream side while repeatedly expanding and turning a flow as the steam S flows through the main flow passage 20. Since the blade bodies 31 have the airfoil cross-sections, the steam S hits the blade bodies 31, and inter-blade flow passages 36 formed between the adjacent blade bodies 31 along the circumferential direction internally receives a reaction force in expansion of the steam. As a result, the rotor 3 rotates. Consequently, energy of the steam S is extracted as a rotational force of the steam turbine 1.

The steam S flowing through the main flow passage 20 in the above-described process also flows into the aforementioned cavities 50. That is, the steam S flowing into the main flow passage 20 is divided into a main steam flow SM and leakage steam flow SL after passing through the stator vane 21. The main steam flow SM is introduced into the turbine rotor blade 30 without any leakage.

The leakage steam flows SL flow into the cavities 50 via between the tip shroud 34 and the casing 2. At this time, the steam S is set in a state in which a swirl component (circumferential velocity component) is increased after passing through the stator vane 21, and a part of the steam S is separated and flows into the cavities 50 as the leakage steam flows SL. Therefore, similarly to the steam S, the leakage steam flows SL also include swirl components.

The leakage steam flows SL flowing into the cavities 50 still include the swirl components even after reaching the first cavity 51 and the second cavity 52 via the gaps m. Therefore, the leakage steam flows SL in the first cavity 51 and second cavity 52 become swirl flows toward a rotational direction R (see FIGS. 1 and 6) of the rotor 3 as the leakage steam flows SL head for the downstream side in the first cavity 51 and the second cavity 52, for example, as shown in FIG. 6.

As described above, it is known that in general, self-excited vibration in the rotary machine is caused by formation of a circumferentially uneven pressure distribution in the cavities 50 between the seal fins 40 when a flow (swirl flow) passing through the stator vane 21 and having a strong circumferential velocity component (a swirl component, or a swirling component) passes through the seal fins 40.

If the circumferentially uneven pressure distribution is formed in the cavities 50, while a force pressing the rotor 3 inward in the radial direction by a pressure in each of the cavities 50 in a portion with a high pressure in each cavity 50 between the seal fins 40 increases, the force pressing the rotor 3 inward in the radial direction by the pressure in each cavity 50 in a portion with a low pressure in each cavity 50 between the seal fins 40 decreases.

As described above, with regard to a pressing force pressing the rotor 3 inward in the radial direction by the pressure in each cavity 50, if a pressing force from one side and a pressing force from the other side facing with the one side across the axis O of the rotor 3 balance each other, the pressing force from one side and the pressing force from the other side facing with the one side across the axis O of the rotor 3 are offset each other.

However, for example, if the pressing force from one side becomes larger than the pressing force from the other side, the rotor 3 is pressed from one side toward the other side by a force of a difference between both the pressing forces facing across the axis O of the rotor 3. Therefore, if the difference between the pressing force from one side and the pressing force from the other side facing across the axis O of the rotor 3 grows, self-excited vibration of the rotor 3 is induced.

Thus, in some embodiments shown in FIGS. 2 to 8, through holes 60 are formed in the tip shroud 34. The through holes 60 penetrate the tip shroud 34 in the radial direction so as to bring regions (the first cavity 51 and the second cavity 52) each defined between a pair of adjacent seal fins 40 and the inter-blade flow passage 36 into communication.

Thus, it is possible to bring a static pressure of the cavity 50 between the pair of adjacent seal fins 40 closer to a static pressure of the inter-blade flow passage 36. As a result of intensive researches by the present inventors, it is known that a circumferential variation in static pressures of the inter-blade flow passages 36 is small compared with a circumferential fluctuation range of the static pressure of the cavity 50 between the pair of adjacent seal fins 40. Therefore, the cavity 50 between the pair of adjacent seal fins 40 and the inter-blade flow passage 36 are brought into communication by the through hole 60, making it possible to suppress a fluctuation in static pressure of the cavity 50 between the pair of adjacent seal fins 40 and to suppress formation of the circumferentially uneven pressure distribution in the cavity 50 between the pair of adjacent seal fins 40. Thus, in the steam turbine 1 including the casing 2, the rotor body 11, and the turbine rotor blade 30 according to some embodiments shown in FIGS. 2 to 6, it is possible to suppress occurrence of self-excited vibration in the rotor 3.

Excepting the bearing portions 4, only a seal portion can implement measures to suppress self-excited vibration in the rotor 3. At this time, in a seal portion on a stator-vane side, circumferential velocity components of the leakage steam flows passing through the seal fins are small and hardly cause induction of self-excited vibration in the rotor 3. In a seal portion on a rotor-blade side, however, since leakage steam flows passing through the stator vanes and having the strong circumferential velocity component passes through the seal fins 40 as described above, which may cause induction of self-excited vibration. Therefore, in some embodiments, measures to suppress self-excited vibration in the rotor 3 is implemented in the seal portion on the rotor-blade side.

Each of the embodiments shown in FIGS. 2 to 8 will be described below.

(First Through Hole 61)

In the turbine rotor blade 30 of the embodiments shown in FIGS. 2 to 8, the tip shroud 34 includes at least one first through hole 61. The at least one first through hole 61 penetrates the tip shroud 34 in the radial direction so as to bring the first cavity 51 and the inter-blade flow passage 36 into communication. The first cavity 51 is defined between the first seal fin 41 and the second seal fin 42, and the inter-blade flow passage 36 is formed between the pair of adjacent blade bodies 31 in the circumferential direction of the rotor body 11.

Therefore, it is possible to bring a static pressure in the first cavity 51 closer to the static pressure of the inter-blade flow passage 36 and to suppress formation of a circumferentially uneven pressure distribution in the first cavity 51. Thus, it is possible to suppress occurrence of self-excited vibration in the steam turbine 1 using the turbine rotor blade 30 of the embodiments shown in FIGS. 2 to 8.

(Second Through Hole 62)

In the turbine rotor blade 30 of the embodiments shown in FIGS. 2 to 8, the tip shroud 34 includes at least one second through hole 62. The at least one second through hole 62 penetrates the tip shroud 34 in the radial direction so as to bring the second cavity 52 defined between the second seal fin 42 and the third seal fin 43, and the inter-blade flow passage 36 into communication.

Thus, it is possible to bring a static pressure in the second cavity 52 closer to the static pressure of the inter-blade flow passage 36 and to suppress formation of a circumferentially uneven pressure distribution in the second cavity 52.

(About Forming Position of First Opening 60*a*)

In the turbine rotor blade 30 of the embodiments shown in FIGS. 2 to 8, the first through hole 61 includes a first opening 60*a* opened on a side of the first cavity 51 and a second opening 60*b* opened on a side of the inter-blade flow passage 36. In the turbine rotor blade 30 of the embodiments shown in FIGS. 2 to 5, the first opening 60*a* of the first through hole 61 is formed at an intermediate position between the first seal fin 41 and the second seal fin 42.

The above-described intermediate position between the first seal fin 41 and the second seal fin 42 is not only a strict intermediate position between the first seal fin 41 and the second seal fin 42 but may be in a range, for example, from 40% to 60% when a position of the first seal fin 41 in the direction of the axis O is 0%, and a position of the second seal fin 42 in the direction of the axis O is 100%. The same also applies to an intermediate position between the second seal fin 42 and the third seal fin 43 to be described later.

The rotor body 11 expands and contracts in the direction of the axis O by thermal expansion, changing its relative position with the casing 2 in the direction of the axis O. Thus, if the seal fins 40 are formed in the casing 2, a relative position of the tip parts of the seal fins 40 and the tip shroud 34 in the direction of the axis O changes. If the relative position of the tip parts of the seal fins 40 and the tip shroud 34 in the direction of the axis O extremely changes, the first opening 60*a* of the first through hole 61 deviates from the first cavity 51.

In this regard, in the turbine rotor blade 30 of the embodiments shown in FIGS. 2 to 5, the first opening 60*a* of the first through hole 61 is formed at the intermediate position between the first seal fin 41 and the second seal fin 42. Thus, as compared with a case in which the first opening 60*a* of the first through hole 61 is formed at a position approaching one of the seal fins 40 from the intermediate position between the first seal fin 41 and the second seal fin 42, it is possible to reduce a possibility of the first opening 60*a* of the first through hole 61 deviating from the first cavity 51 by changing the relative position of the tip parts of the seal fins 40 and the tip shroud 34 in the direction of the axis O.

In the turbine rotor blade 30 of the embodiments shown in FIGS. 2 to 5, the first opening 60*a* of the second through hole 62 may be formed at the intermediate position between the second seal fin 42 and the third seal fin 43. In the turbine rotor blade 30 of the embodiments shown in FIGS. 2 to 5, if the first opening 60*a* of the second through hole 62 is formed at the intermediate position between the second seal fin 42 and the third seal fin 43, the same effect as the above-described effect is achieved.

(About Forming Position of Second Opening 60*b*)

Figure 5:
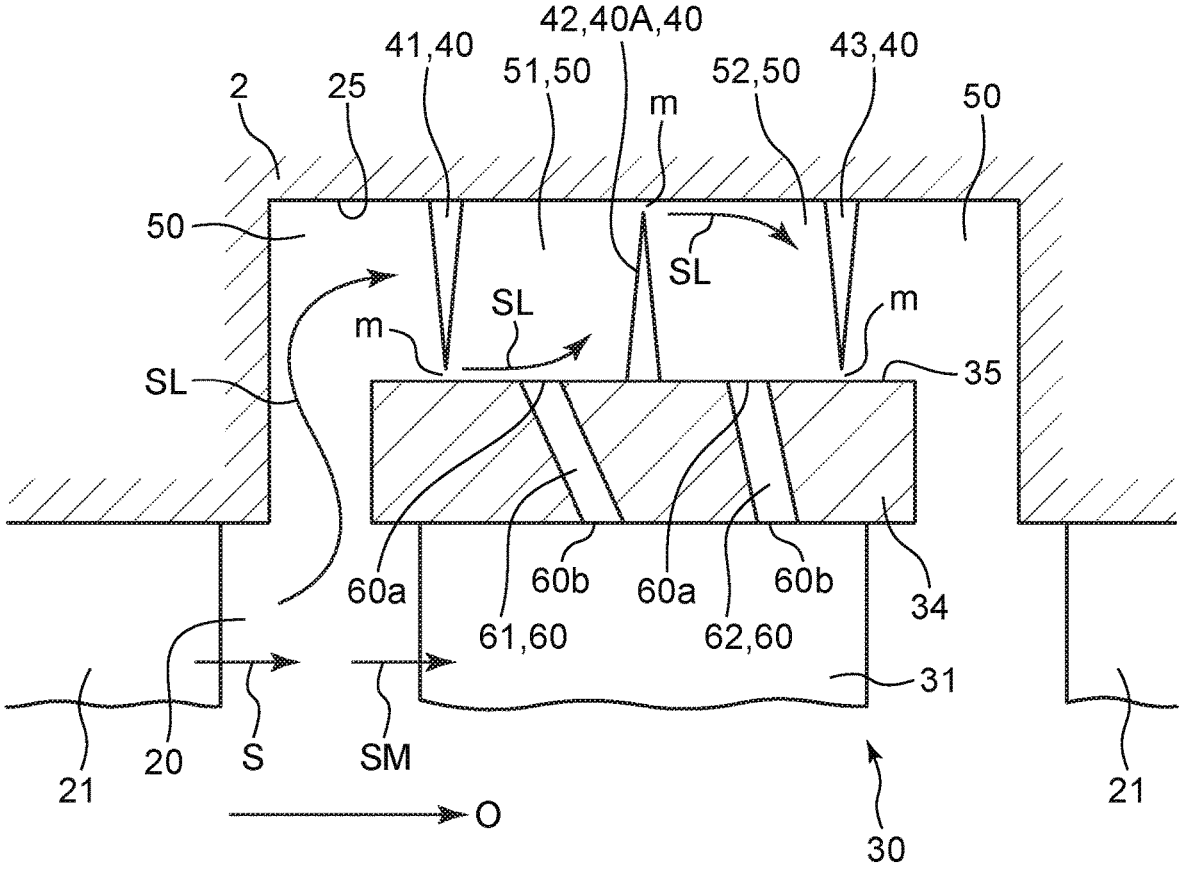
FIG. 5 is a schematic view taken in the vicinity of a tip end part of a blade element of the turbine rotor blade according to some embodiments.

In the turbine rotor blade 30 of the embodiments shown in FIGS. 3 to 5, the second opening 60*b* of the first through hole 61 is formed at a position facing the inter-blade flow passage 36 and having the same static pressure as a static pressure at a position facing the first opening 60*a* of the first through hole 61, for example, as shown in FIG. 3. This will be described below in detail.

A graph shown in FIG. 3 is a graph showing a relationship between a position in the direction of the axis O, and a mean static pressure Psc in the cavities 50 and a mean static pressure Pcp in the inter-blade flow passages 36. In the graph of FIG. 3, x-axis indicating positions in the direction of the axis O is depicted so as to correspond to positions in the direction of the axis O in the schematic view of the turbine rotor blade 30 in FIG. 3. A solid line graph 91 indicates the mean static pressure Psc in the cavities 50, and a single-dotted chain line graph 92 indicates the mean static pressure Psp in the inter-blade flow passages 36. The mean static pressure Psc in the cavities 50 and the mean static pressure Psp in the inter-blade flow passages 36 are, for example, time average values in a steady state on a certain operation condition of the steam turbine 1.

The mean static pressure Psc in the cavities 50 and the mean static pressure Psp in the inter-blade flow passages 36 are substantially the same on an upstream side of the blade body 31. The mean static pressure Psc in the cavities 50 decreases stepwise after each pass through the seal fin 40. In addition, the mean static pressure Psp in the inter-blade flow passages 36 gradually decreases toward the downstream side along the direction of the axis O. The mean static pressure Psc in the cavities 50 and the mean static pressure Psp in the inter-blade flow passages 36 become substantially the same again on a downstream side of the blade body 31.

In a section between a forming position x1 of the first seal fin 41 and a forming position x3 of the second seal fin 42, the mean static pressure Psp in the inter-blade flow passages 36 is higher than the mean static pressure Psc in the cavities 50 in a section of the upstream, that is, a section on the left side in the drawing, and the mean static pressure Psp in the inter-blade flow passages 36 is lower than the mean static pressure Psc in the cavities 50 in a section on the downstream side, that is, a section on the right side in the drawing. Therefore, at a position x2 between the forming position x1 of the first seal fin 41 and the forming position x3 of the second seal fin 42, the mean static pressure Psp in the inter-blade flow passages 36 and the mean static pressure Psc in the cavities 50 become equal to each other.

Similarly, in a section between the forming position x3 of the second seal fin 42 and a forming position x5 of the third seal fin 43, the mean static pressure Psp in the inter-blade flow passages 36 is higher than the mean static pressure Psc in the cavities 50 in the section on the upstream side, and the mean static pressure Psp in the inter-blade flow passages 36 is lower than the mean static pressure Psc in the cavities 50 in the section on the downstream side. Therefore, at a position x4 between the forming position x3 of the second seal fin 42 and the forming position x5 of the third seal fin 43, the mean static pressure Psp in the inter-blade flow passages 36 and the mean static pressure Psc in the cavities 50 become equal to each other.

In the turbine rotor blade 30 of the embodiments shown in FIGS. 3 to 5, the second opening 60*b* of the first through hole 61 is formed at the position x2 having the same static pressure as the static pressure at the position facing the first opening 60*a* of the first through hole 61, for example, as shown in FIG. 3.

Therefore, if the above-described circumferentially uneven pressure distribution which may cause self-excited vibration in the steam turbine 1 is not formed in the cavities 50, the steam S does not flow between the first cavity 51 and the inter-blade flow passage 36. Thus, it is possible to suppress a decrease in turbine efficiency by, for example, a flow of the main steam flow SM flowing through the inter-blade flow passage 36 to the first cavity 51.

The position x2 having the same static pressure as the static pressure at the position facing the first opening 60*a* of the first through hole 61 is not limited to a position at which the mean static pressure Psc of the first cavity 51 at the position facing the first opening 60*a* of the first through hole 61 and the mean static pressure Psp of the inter-blade flow passages 36 at the position facing the second opening 60*b* of the first through hole 61 strictly match.

For example, the position x2 having the same static pressure as the static pressure at the position facing the first opening 60*a* of the first through hole 61 may be a position at which the mean static pressure Psp of the inter-blade flow passages 36 at the position facing the second opening 60*b* of the first through hole 61 becomes a pressure within a range of, for example, from minus 10% to plus 10% of a differential pressure before and after the first seal fin 41 with respect to the mean static pressure Psc of the first cavity 51 at the position facing the first opening 60*a* of the first through hole 61.

The same also applies to the position x4.

In the turbine rotor blade 30 of the embodiments shown in FIGS. 3 to 5, the second opening 60*b* of the second through hole 62 may be formed at the position x4 having the same static pressure as the static pressure at the position facing the first opening 60*a* of the second through hole 62. In the turbine rotor blade 30 of the embodiments shown in FIGS. 3 to 5, if the second opening 60*b* of the second through hole 62 is formed at the position x4 having the same static pressure as the static pressure at the position facing the first opening 60*a* of the second through hole 62, the same effect as the above-described effect is achieved.

When forming the second opening 60*b* of the first through hole 61 at the position x2, and forming the second opening 60*b* of the second through hole 62 at the position x4, as shown in FIGS. 3 and 5, the first through hole 61 and the second through hole 62 may linearly be formed. In addition, when forming the second opening 60*b* of the first through hole 61 at the position x2, and forming the second opening 60*b* of the second through hole 62 at the position x4, for example, as shown in FIG. 4, the first through hole 61 and the second through hole 62 may respectively include first-cavity-side flow passage portions 611 and 621, and inter-blade-side flow passage portions 612 and 622 having different extending directions, as will be described later.

(About Inter-Blade-Side Flow Passage Portions 612 and 622)

In the turbine rotor blade 30 of the embodiments shown in FIGS. 4 and 6 to 8, the first through holes 61 include the first-cavity-side flow passage portions 611 connected to the first openings 60*a* and the inter-blade-side flow passage portions 612 connected to the second openings 60*b*. In addition, in the turbine rotor blade 30 of the embodiments shown in FIGS. 4 and 6 to 8, the second through holes 62 include the second-cavity-side flow passage portions 621 connected to the first openings 60*a* and the inter-blade-side flow passage portions 622 connected to the second openings 60*b*. That is, in the turbine rotor blade 30 of the embodiments shown in FIGS. 4 and 6 to 8, the first through holes 61 include the first-cavity-side flow passage portions 611 and the inter-blade-side flow passage portions 612 having the different extending directions. In addition, the second through holes 62 include the second-cavity-side flow passage portions 621 and the inter-blade-side flow passage portions 622 having the different extending directions.

In the turbine rotor blade 30 of the embodiments shown in FIGS. 7 and 8, the inter-blade-side flow passage portions 612 of the first through holes 61 are oriented to the downstream sides of the inter-blade flow passages 36. That is, the first through hole 61 shown in FIGS. 7 and 8 is formed so as to extend along a direction of a main flow of the main steam flow SM when seeing the turbine rotor blade 30 on the outer side in the radial direction.

The extending direction of the first through hole 61 shown in FIGS. 7 and 8 when seeing the turbine rotor blade 30 on the outer side in the radial direction, for example, may not necessarily match the direction of the main flow of the main steam flow SM flowing through the inter-blade flow passage 36, and it is only necessary that, for example, a deviation from the direction of the main flow of the main steam flow SM flowing through the inter-blade flow passage 36 is, for example, 45 degrees or less.

Consequently, when the leakage steam flow SL flowing through the first cavity 51 flows out to the inter-blade flow passage 36, the leakage steam flow SL flows out along a flow of the main steam flow SM in the inter-blade flow passage 36. Thus, it is possible to suppress a loss associated with merging of the flow of the main steam flow SM in the inter-blade flow passage 36 and the leakage steam flow SL flowing from the first through hole 61 to the inter-blade flow passage 36, and to suppress the decrease in turbine efficiency.

In the turbine rotor blade 30 of the embodiment shown in FIG. 7, similarly to the inter-blade-side flow passage portions 612 of the first through holes 61, the inter-blade-side flow passage portions 622 of the second through holes 62 may be oriented to the downstream sides of the inter-blade flow passages 36. In the turbine rotor blade 30 of the embodiment shown in FIG. 7, if the inter-blade-side flow passage portion 622 of the second through hole 62 is oriented to the direction of the main flow of the main steam flow SM, the same effect as the above-described effect is achieved.

Also for the turbine rotor blade 30 of the embodiments shown in FIGS. 3 to 5, the same effect as the above-described effect is achieved by orienting the first through hole 61 and the second through hole 62 to the downstream sides of the inter-blade flow passages 36 on the sides of the second openings 60*b*.

(About First-Cavity-Side Flow Passage Portion 611 and Second-Cavity-Side Flow Passage Portion 612)

In the turbine rotor blade 30 of the embodiment shown in FIG. 6, the first-cavity-side flow passage portions 611 of the first through holes 61 are oriented to an upstream side of the rotational direction R of the rotor body 11 in the first cavity 51.

As described above, it is known that in general, self-excited vibration in the rotary machine is generated easily as a circumferential velocity of a working fluid flowing in the cavities 50 between the seal fins 40 in the circumferential direction increases.

In this regard, in the turbine rotor blade 30 of the embodiment shown in FIG. 6, since the first-cavity-side flow passage portions 611 of the first through holes 61 are oriented to the upstream side of the rotational direction R of the rotor body 11 in the first cavity 51, when flowing out to the first cavity 51, the main steam flow SM flowing through the inter-blade flow passages 36 flows out from the first openings 60*a* toward the upstream side of the rotational direction R of the rotor body 11 in the first cavity 51, that is, flows out so as to go against the flow of the leakage steam flow SL flowing in the first cavity 51 toward the circumferential direction. Thus, suppression of a flow velocity of the leakage steam flow SL flowing in the first cavity 51 toward the circumferential direction contributes to suppression of occurrence of self-excited vibration.

In the turbine rotor blade 30 of the embodiment shown in FIG. 6, the second-cavity-side flow passage portions 621 of the second through holes 62 may be oriented to the upstream side of the rotational direction R of the rotor body 11 in the second cavity 52. In the turbine rotor blade 30 of the embodiment shown in FIG. 6, if the second-cavity-side flow passage portions 621 of the second through holes 62 are oriented to the upstream side of the rotational direction R of the rotor body 11 in the second cavity 52, the same effect as the above-described effect is achieved.

(About Rotational Balance of Rotor 3)

For example, as shown in FIG. 6, the turbine rotor blade 30 of some embodiments includes the plurality of first through holes 61 having the same diameter. The plurality of first through holes 61 are formed at regular intervals along the circumferential direction over the entire periphery of the annular tip shroud 34.

Thus, it is possible to suppress a loss in rotational balance of the rotor 3.

In addition, for example, as shown in FIG. 6, in the turbine rotor blade 30 of some embodiments, the same effect as the above-described effect is achieved by forming the plurality of second through holes 62 having the same diameter at regular intervals along the circumferential direction over the entire periphery of the annular tip shroud 34.

The first through holes 61 and the second through holes 62 may be formed so as to correspond to all the plurality of inter-blade flow passages 36 disposed along the circumferential direction, or may be formed at equal intervals so as to correspond to some of the plurality of inter-blade flow passages 36 disposed along the circumferential direction, such as every other or every third inter-blade flow passages 36.

In addition, for example, as shown in FIG. 6, for example, with regard to two types of first through holes 61A and first through hole 61B having different diameters, the first through holes 61A each having one diameter may be formed so as to correspond to, for example, every other inter-blade flow passage 36 with respect to the plurality of inter-blade flow passages 36 disposed along the circumferential direction. Then, for example, the first through hole 61B having the other diameter may be formed so as to correspond to, of the plurality of inter-blade flow passages 36 disposed along the circumferential direction, the inter-blade flow passage 36 which is not in communication with the first through hole 61A having one diameter. Even in such a case, the first through holes 61A each having one diameter are formed at the regular intervals along the circumferential direction over the entire periphery of the annular tip shroud 34, and the first through holes 61B each having the other diameter are formed at regular intervals along the circumferential direction over the entire periphery of the annular tip shroud 34.

Embodiments of the present invention were described in detail above, but the present invention is not limited thereto, and various amendments and modifications may be implemented.

For example, in the above-described some embodiments, hole diameters of the first through holes 61 and second through holes 62 are not particularly mentioned. However, a hole diameter from each first opening 60*a* to a corresponding one of the second openings 60*b* may be constant or may change midway. In addition, cross-sectional shapes of the first through holes 61 and second through holes 62 may be a circular shape or an oval shape, or may be a shape other than the circular shape or the oval shape, such as a polygonal shape.

In addition, in the above-described some embodiments, the steam turbine 1 has been described as an example of the rotary machine. However, another rotary machine such as a gas turbine may be used.

The invention claimed is:

1. A turbine rotor blade comprising:

a plurality of blade bodies which are mounted so as to extend in a radial direction from a rotor body rotatable about an axis in a casing, the plurality of blade bodies being disposed at intervals in a circumferential direction of the rotor body; and an annular tip shroud connected to each tip end part of the plurality of blade bodies, wherein the tip shroud includes at least one first through hole, and the at least one first through hole penetrates the tip shroud in the radial direction so as to bring a first cavity and an inter-blade flow passage into communication, wherein the first cavity is defined between a first seal fin and a second seal fin, the first seal fin extends in the radial direction from one of an outer peripheral surface of the tip shroud or an inner peripheral surface of the casing toward the other of the outer peripheral surface or the inner peripheral surface, and has a tip part, the first seal fin forms a gap between the tip part and the other of the outer peripheral surface or the inner peripheral surface, the second seal fin extends in the radial direction from one of the outer peripheral surface of the tip shroud or the inner peripheral surface of the casing toward the other of the outer peripheral surface or the inner peripheral surface at a position spaced apart from the first seal fin in a direction of the axis, and has a tip part, the second seal fin forms a gap between the tip part and the other of the outer peripheral surface or the inner peripheral surface, the inter-blade flow passage is formed between a pair of adjacent blade bodies in the circumferential direction of the rotor body, the at least one first through hole includes a first opening opened on a side of the first cavity and a second opening opened on a side of the inter-blade flow passage, the first opening is formed at an intermediate position between the first seal fin and the second seal fin, and the second opening is formed at a position facing the inter-blade flow passage, the position of the second opening having the same static pressure as a static pressure at the intermediate position facing the first opening.

2. The turbine rotor blade according to claim 1, wherein the at least one first through hole includes the first opening opened on the side of the first cavity and a first-cavity-side flow passage portion connected to the first opening, and wherein the first-cavity-side flow passage portion is oriented to an upstream side of a rotational direction of the rotor body in the first cavity.

3. The turbine rotor blade according to claim 1, wherein the at least one first through hole includes the second opening opened on the side of the inter-blade flow passage and an inter-blade-side flow passage portion connected to the second opening, and wherein the inter-blade-side flow passage portion is oriented to a downstream side of the inter-blade flow passage.

4. The turbine rotor blade according to claim 1, wherein the at least one first through hole includes a plurality of first through holes having the same diameter, and wherein the plurality of first through holes are formed at regular intervals along the circumferential direction over an entire periphery of the annular tip shroud.

5. The turbine rotor blade according to claim 1, wherein the tip shroud includes at least one second through hole, and the second through hole penetrates the tip shroud in the radial direction so as to bring a second cavity and the inter-blade flow passage into communication, wherein the second cavity is defined between the second seal fin and a third seal fin, the third seal fin extends in the radial direction from one of the outer peripheral surface of the tip shroud or the inner peripheral surface of the casing toward the other of the outer peripheral surface or the inner peripheral surface at a position spaced apart from the second seal fin in the direction of the axis from the first seal fin toward the second seal fin, and has a tip part, and the third seal fin forms a gap between the tip part and the other of the outer peripheral surface or the inner peripheral surface.

6. A rotary machine comprising:

the turbine rotor blade according to claim 1; and the casing.

* * * * *